US007217225B2

(12) United States Patent
Husted et al.

(10) Patent No.: US 7,217,225 B2
(45) Date of Patent: May 15, 2007

(54) SUSPENSION SYSTEM FOR GLIDER EXERCISE DEVICE

(76) Inventors: Royce H. Husted, 1295 Old Elkton Dr., Forest, VA (US) 24551; Joel P. Husted, 1455 Old Elkton Dr., Forest, VA (US) 24551

( * ) Notice: Subject to any disclaimer, the term of this patent is extended or adjusted under 35 U.S.C. 154(b) by 146 days.

(21) Appl. No.: 10/943,478

(22) Filed: Sep. 18, 2004

(65) Prior Publication Data

US 2005/0054489 A1 Mar. 10, 2005

Related U.S. Application Data

(63) Continuation-in-part of application No. 10/657,645, filed on Sep. 8, 2003, now abandoned.

(51) Int. Cl.
*A63B 22/06* (2006.01)

(52) U.S. Cl. ..... 482/51; 482/52

(58) Field of Classification Search ..... 482/51–53, 482/57, 70, 79, 80, 56, 121, 128, 148
See application file for complete search history.

(56) References Cited

U.S. PATENT DOCUMENTS

| | | | | |
|---|---|---|---|---|
| 5,318,490 | A * | 6/1994 | Henderson et al. | 482/53 |
| 6,117,052 | A * | 9/2000 | Frost et al. | 482/52 |
| 6,152,859 | A * | 11/2000 | Stearns | 482/52 |
| 6,277,055 | B1 * | 8/2001 | Birrell et al. | 482/52 |
| 6,796,928 | B1 * | 9/2004 | Christopher et al. | 482/51 |

* cited by examiner

*Primary Examiner*—(Jackie) Tan-Uyen Ho
*Assistant Examiner*—Tam Nguyen
(74) *Attorney, Agent, or Firm*—Nicholas A Camasto

(57) ABSTRACT

A glider device includes a pair of swingably mounted foot platforms pivotally supported by links at their heel ends. A spring cage, in one embodiment, includes a tension spring in each link to resiliently support the heel end of the foot platform. The spring cage limits displacement of the tension spring and includes a compression spring that cushions the displacement of the tension spring. In the a second, preferred embodiment, a stack of rubber bushings is supported in the spring cage and compress and decompress to provide a cushioning action to the foot platform.

4 Claims, 5 Drawing Sheets

Fig. 4
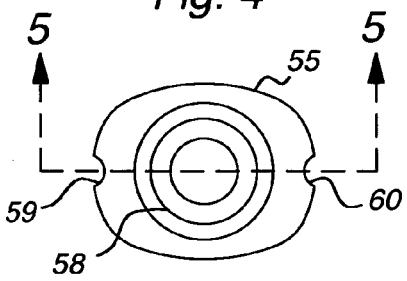
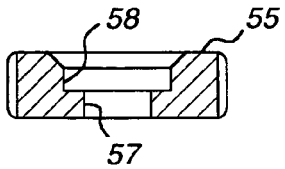
Fig. 5
Fig. 8
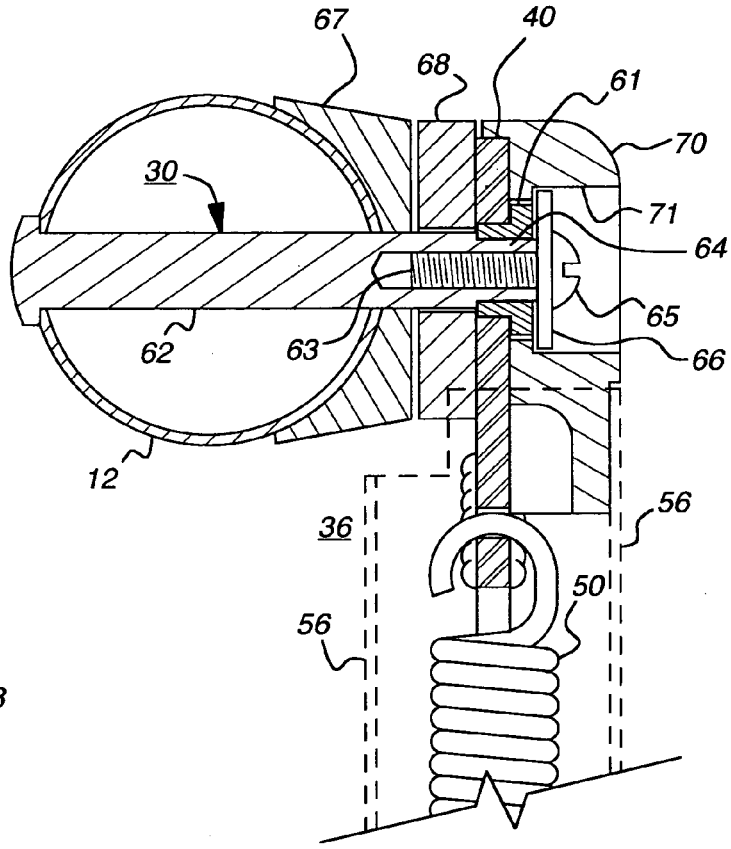
Fig. 6
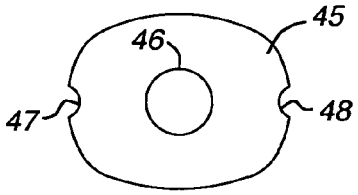
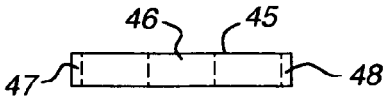
Fig. 7

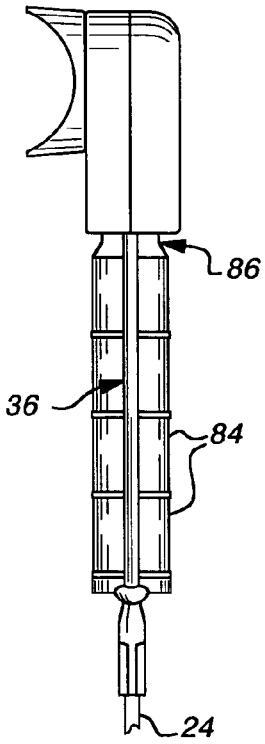
FIG. 12
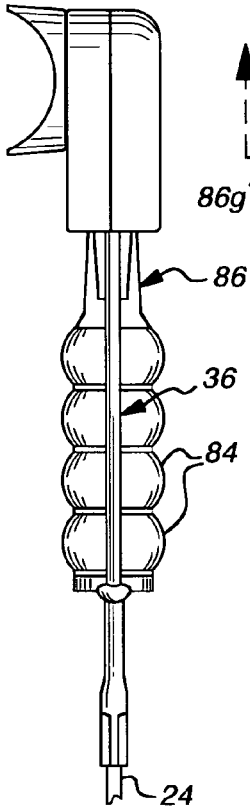
FIG. 13
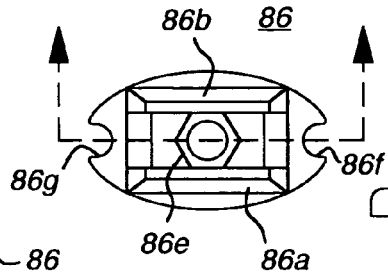
FIG. 15
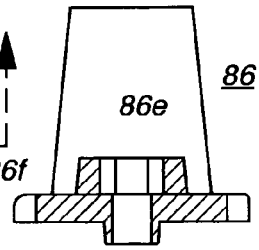
FIG. 18
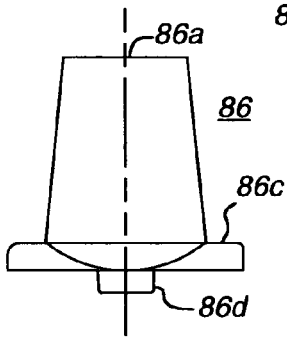
FIG. 14
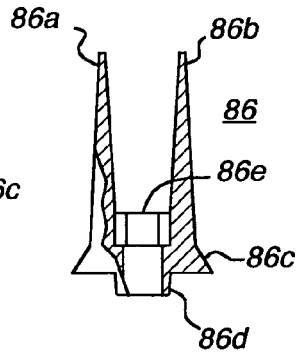
FIG. 17
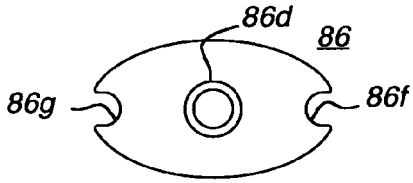
FIG. 16
FIG. 22
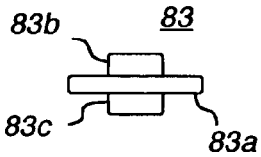
FIG. 20
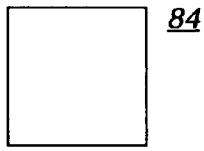
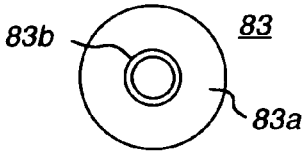
FIG. 21
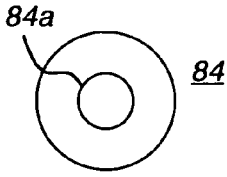
FIG. 19

SUSPENSION SYSTEM FOR GLIDER EXERCISE DEVICE

This Application is a Continuation-In-Part of application Ser. No. 10/657,645, filed Sep. 8, 2003 (now abandoned), of the same title and inventorship.

BACKGROUND OF THE INVENTION AND PRIOR ART

This invention relates in general to glider type exercise equipment, such as the equipment described and claimed in the inventor's U.S. Pat. Nos. 5,795,268, 5,857,940, D390,628 and D403,033, and in particular to a novel suspension system for such equipment. The patented exercise gliders feature very low impact in a device that simulates a full range of natural striding motion, including aggressive striding, for achieving both upper and lower body workouts.

With the patented exercise devices, a full range of striding motion is very closely simulated while impact on the user's body is practically eliminated. Significantly, the aerobic effect experienced is readily controllable by merely accelerating the striding action and lengthening the stride, precisely as can be done when aggressively striding over a stationary surface. However, unlike striding, with the inventive device a user can lean backward and forward to transfer significant weight to his arms, chest and back without loss of balance or control. This not only increases the aerobic effort and enables an upper body workout, but also varies the muscle groups that are being exercised.

The spring suspension system of the present invention incorporates a shock absorbing arrangement that adds a slight cushion effect to the rear of each foot platform for enhancing the gliding action. Essentially, springs permit the heel ends of the foot platforms to move up and down (within defined limits) to resiliently modify the radial paths traversed by the foot platforms. The effect is to further reduce the stress on both the user's body and the exercise machine structure. The novel suspension system is achieved with a simple, low cost, shock absorbing arrangement that may be readily added to the patented gliders.

OBJECTS OF THE INVENTION

A principal object of the invention is to provide a novel suspension system for a low impact glider exercise apparatus.

Another object of the invention is to provide a novel glider exercise apparatus.

A further object of the invention is to provide an improved suspension system for a low impact glider exercise apparatus.

BRIEF DESCRIPTION OF THE DRAWINGS

These and other objects and advantages of the invention will become apparent upon reading the following description in conjunction with the drawings, in which:

FIG. 4 is a plan view of the spring retainer of the spring cage of FIG. 2;

FIG. 5 is a cross section of the spring retainer of FIG. 4, taken along the line 5—5;

FIGS. 6 and 7 are views of the base 45 of the FIG. 2 spring cage;

FIG. 8 is a enlarged partial cross section taken along line 8—8 of FIG. 1 illustrating the attachment of the spring cage to the rear leg of the glider apparatus;

FIGS. 12 and 13 illustrate the normal and extended positions of the preferred form of suspension system of the invention;

FIGS. 14–18 are views of the pinch guard 86 of the spring cage of FIG. 9;

FIGS. 19 and 20 illustrate the rubber bushings of the spring cage of FIG. 9; and FIGS. 21 and 22 illustrate the bushing separators.

SUMMARY OF THE INVENTION

The invention comprises a shock absorbing spring cage in the link that supports the swingable foot platform from the frame of a glider type exercise machine.

DESCRIPTION OF THE PREFERRED EMBODIMENT

Figure 1:
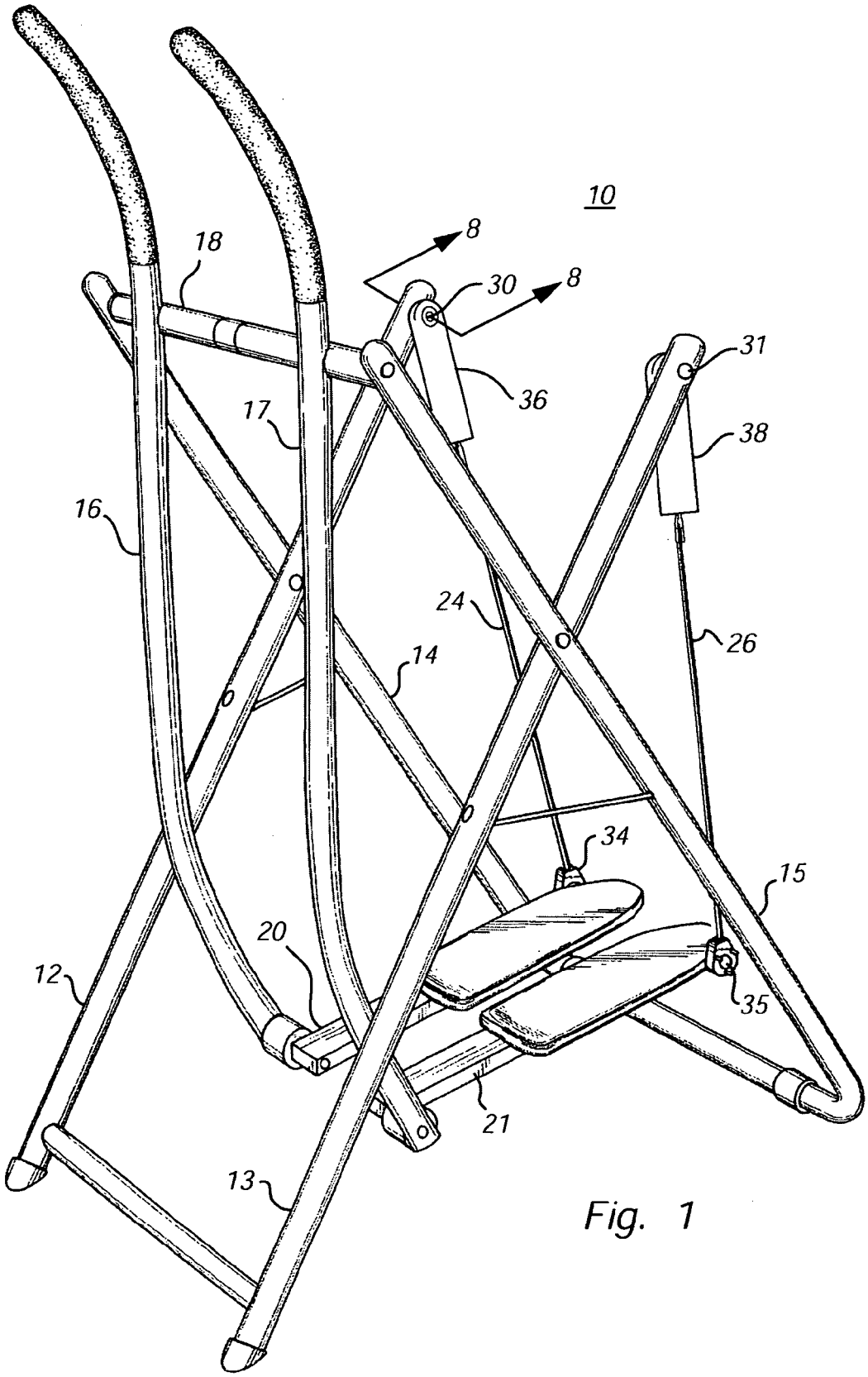
FIG. 1 is a perspective of a fold-away low impact glider apparatus incorporating the novel suspension system of the invention.
Figure 2:
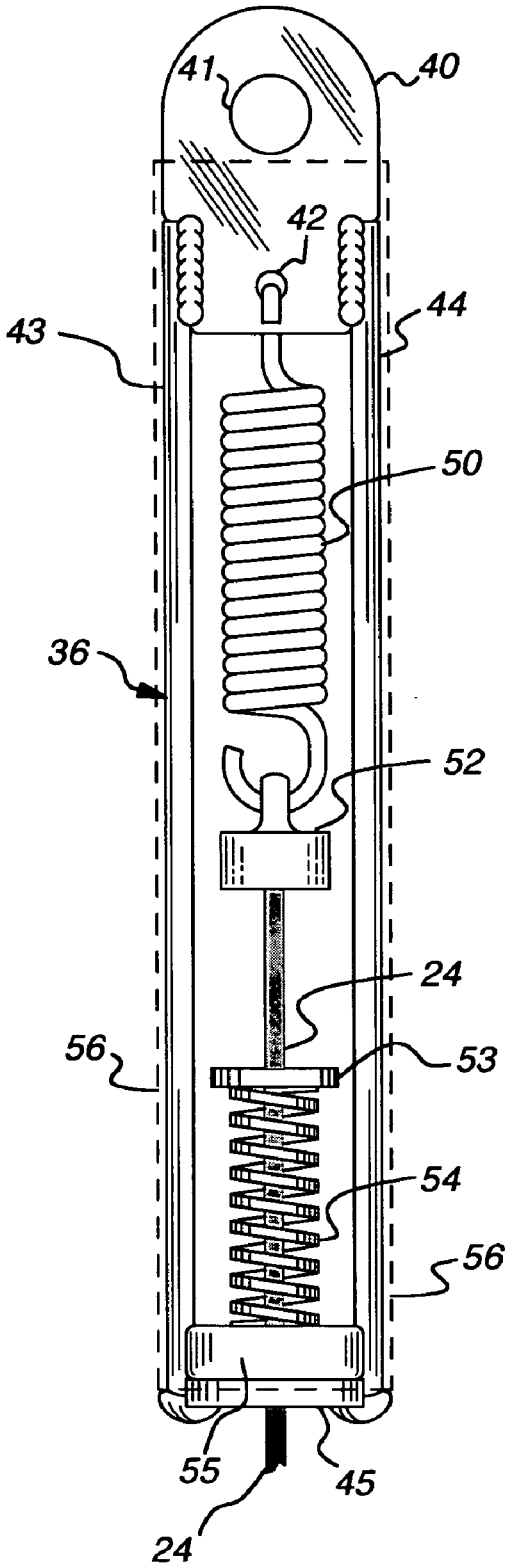
FIG. 2 shows one version of a spring cage of the invention.
Figure 3:
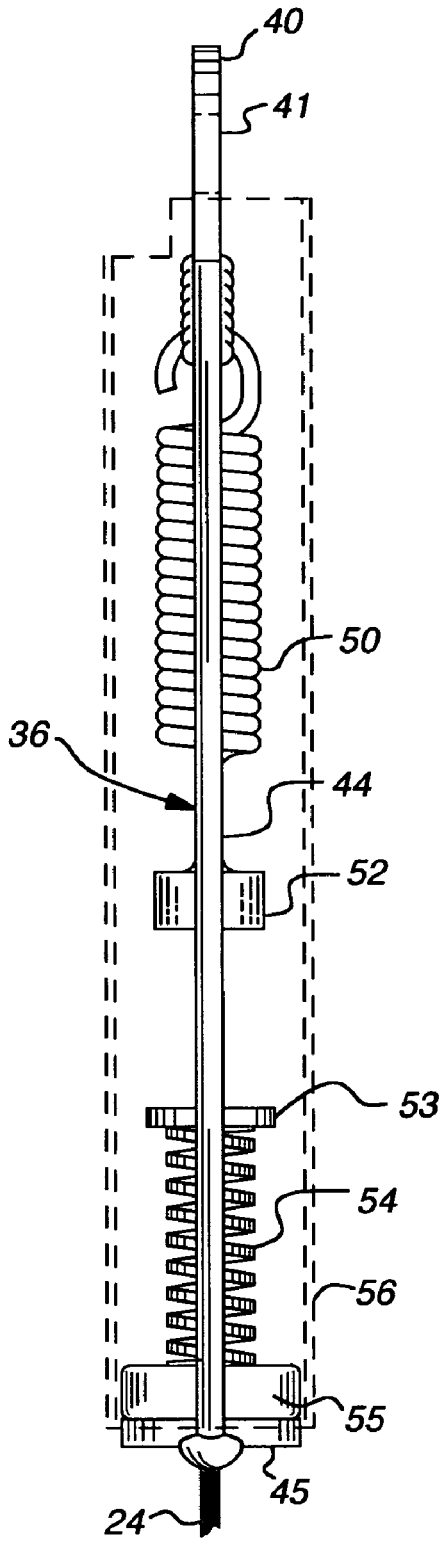
FIG. 3 is a side elevation of the spring cage of FIG. 2.
Figure 9:
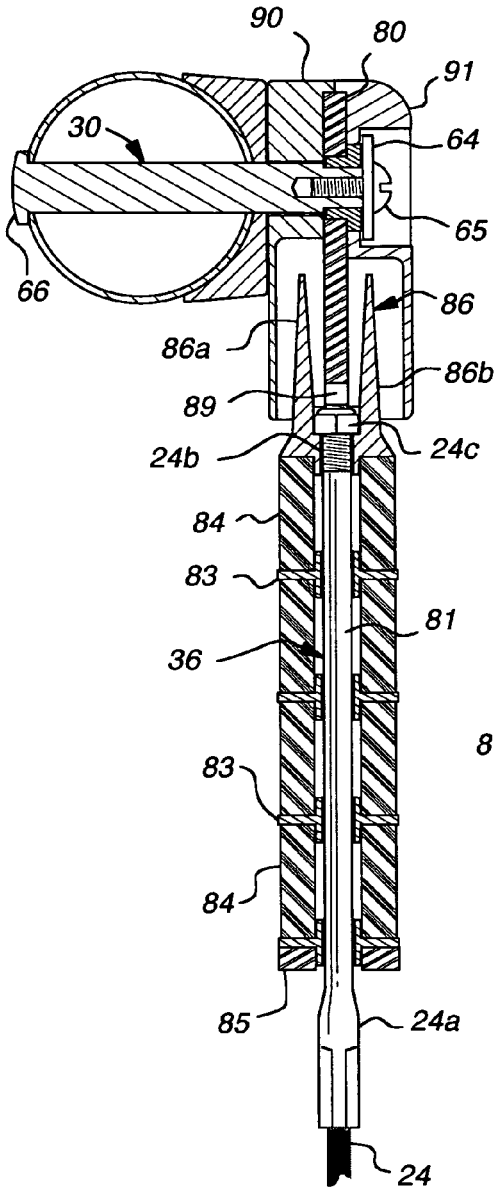
FIG. 9 is an enlarged partial cross section taken along line 8—8 of FIG. 1 illustrating a second, preferred version of a spring cage of the invention and its attachment to the glider apparatus.

Referring to FIG. 1, a glider type exercise apparatus 10 as shown in the above-mentioned patents includes a fold-away frame consisting of front legs 12,13 and rear legs 14,15 that are arranged for swingably supporting a pair of foot platforms 20,21. A pair of swing arms, 16,17, pivotally supported on a cross member 18 of the frame, is pivotally connected to the toe ends of foot platforms 20,21, respectively. The heel ends of foot platforms 20,21 are coupled by heel end pivots 34,35 to a pair of links 24,26, respectively. The links 24,26 are in turn coupled, via spring cages 36,38 to a pair of rear pivots 30,31 on legs 12,13, respectively. While the links 24,26 may be rigid, in the preferred embodiments of the apparatus, the links comprise steel cables. The apparatus functions, in a well-known manner to enable a user standing on the foot platforms and grasping the swing arms to engage in an aerobic upper and lower body workout with minimal impact to his body.

FIGS. 2–7 illustrate various features of one version of spring cage 36 of the invention, it being understood that spring cage 38 is a mirror image thereof. A top plate 40, preferably made of steel, is welded to the upper ends of a pair of steel tie rods 43,44 that are welded at their lower ends to a steel base plate 45 (FIGS. 6 and 7) to form a generally cylindrical structure. Top plate 40 includes a hole 41 for pivotal mounting to rear pivot 30 and a small hole 42 for attaching the upper end of a tension spring 50. The lower end of tension spring 50 is connected to an intermediate member 52, preferably made of steel, that serves as a coupler for the upper end of link 24. In practice, link 24 is a cable having a threaded stud secured to its upper end for secure engagement with intermediate member (cable coupler) 52. A compression spring 54, which encircles link 24, has its lower end seated in a spring retainer 55 (FIGS. 4 and 5). A polyurethane washer 53 is positioned atop compression spring 54 and serves to cushion the impact between intermediate member 52 and compression spring 54 upon elongation of tension spring 50. A plastic shield 56 covers the major portions of spring cage 36.

As more clearly shown in FIGS. 4 and 5, spring retainer 55 includes a pair of edge notches 59,60 that partially encircle the round circumferences of tie rods 43,44. The spring retainer has a central orifice 57 through which link 24 freely passes and a circular recess 58 for receiving the bottom end of compression spring 54. Spring retainer 55 is preferably made of a plastic material and is dimensioned such that it is a force fit between tie rods 43,44.

FIGS. 6 and 7 show details of base plate 45, in particular the end notches 47,48 which are welded to the ends of tie rods 43,44, respectively and the central orifice 46, through which link 24 freely passes.

In FIG. 8, details of the pivotal attachment of the spring cage to the upper (rear) part of front leg 12 are shown. Pivot 30 comprises a cylindrical pin 62 which passes through leg 12 and includes an axle portion 64. A screw 63 engages pin 62 with washer 66. A contoured spacer 67, through which pin 62 passes, engages the circular periphery of leg 12 and presents a flat surface that engages a plastic washer 68. A bearing 61, having a stepped diameter for engaging hole 41 in top plate 40 and an inner, hole-engaging axle portion 64, centers the spring cage 36 on pin 62. A plastic cover 70 has a stepped orifice 71 for accepting a washer 66, with everything being secured together by the screw head 65. The arrangement enables free pivotal movement of spring cage 36 about pin 62, thus defining the rear pivot 30.

FIGS. 9–13 illustrate another, preferred, form of shock absorbing arrangement of the present invention. Spring cage 36 in this embodiment comprises a frame having an upper plate 80, a lower plate 85 and a pair of steel tie rods 81 and 82 welded together in a manner similar to that previously described in connection with FIGS. 2 and 3. The shock absorbing arrangement in this preferred embodiment differs in that compression rubber bushings 84 (FIGS. 19,20) and plastic spacers 83 (FIGS. 21 and 22) are provided, rather than a combination of tension and compression springs. The end of link 24, which is preferably a cable, is secured to a cylindrical rod 24*a* that includes a threaded end 24*b* to which a nut 24*c* is attached. Bushings 84 and spacers 83 are stacked around rod 24*a* and supported between lower plate 85 and a pinch guard 86 (FIGS. 14–18). Normally, the stack of bushings 84 is undistorted as shown in FIG. 12, but when load is applied to link 24, bushings 84 compress, as illustrated by the bulging in FIG. 13. The bushings 84 may be of any suitable material such as rubber or polyurethane, whereas the spacers 83 and pinch guard 86 are preferably molded of plastic. A decorative cover, consisting of an inner portion 90 and an outer portion 91, is also molded of plastic.

Figure 10:
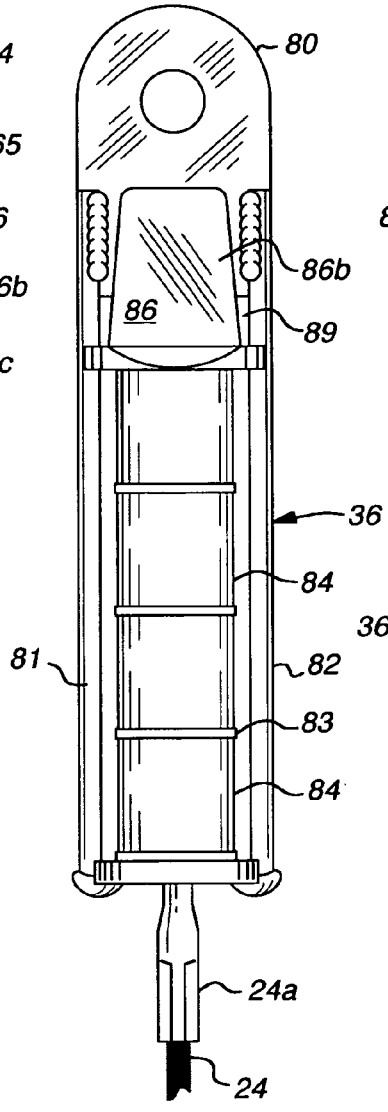
FIGS. 10 and 11 are two views of the preferred spring cage of FIG. 9.
Figure 11:
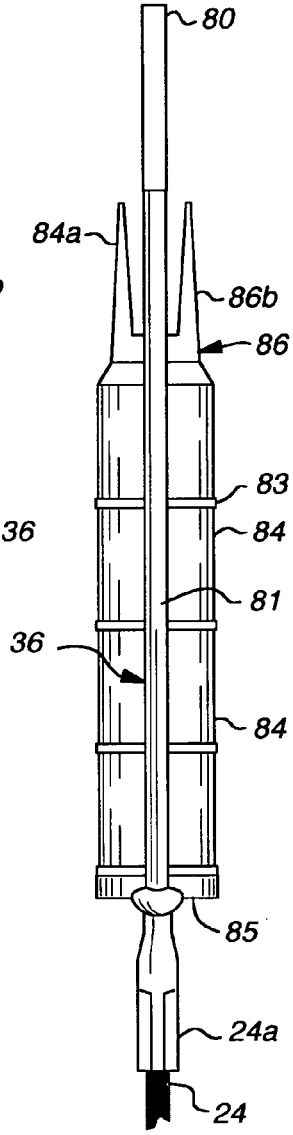

A gap 89, of variable length, exists between the bottom of upper plate 80 and threaded end 24*b* of rod 24*a*. Pinch guard 86 not only secures the top of the stack of bushings, but substantially blocks access to gap 89 at all times, thus precluding inadvertent admission of objects into this gap. Referring to FIGS. 14–18, pinch guard 86 includes a pair of broad wings 86*a* and 86*b* that extend upward from a base 86*c*. Base 86*c* is molded with a depending collar 86*d*, having an inner diameter sized to fit over rod 24*b*, an outer diameter sized to fit within bushing 84 and forming a hexagonally-shaped aperture 86*e* for captivating nut 24*c*. Its ends are formed with semicircular cutouts 86*f* and 86*g* for sliding engagement with the spring cage tie rods 81 and 82, respectively (FIG. 10).

Each rubber bushing 84, as illustrated in FIGS. 19 and 20, is of cylindrical shape and includes a circular opening 84*a* for receiving either pinch guard 86 or the spacers 83. As shown in FIGS. 21 and 22, each spacer 83 includes a circular base 83*a*, slightly larger than the outer diameter of bushing 84, and upper and lower collars 83*b* and 83*c* that are dimensioned to fit in circular opening 84 of bushing 84 and around rod 24*a*

It will be appreciated by those skilled in the art that the spring cage may be located anywhere in the link, although its placement as shown at rear pivot 30 is preferred. In the first-described embodiment of the invention tension spring 50 has an overall length of 3.375 in. and a spring rate of 76 lbs/in. and compression spring 54 has an overall length of 1.5 in. and a spring rate of 108 lbs/in. In the second-described, preferred embodiment of the invention, the bushings are cylindrical, each having a 1.00 inch outer diameter, a 0.375 inch inner diameter and a 1.00 inch length. The rubber material has a hardness of 70 Shore A.

What has been described is a novel suspension system for a glider type exercise device that further reduces the stress on the user's body and the exercise apparatus when in operation provides a low impact simulation of walking and striding, including aggressive striding, and aerobic upper and lower body exercises. It is recognized that numerous changes to the described embodiment of the invention will be apparent to those skilled in the art without departing from its true spirit and scope. The invention is to be limited only as defined in the claims.

The invention claimed is:

1. A glider exercise machine comprising:

a frame;

a foot platform;

a link coupled between a pivot on said frame and a pivot on said foot platform for swingably supporting said foot platform from said frame;

a shock absorbing arrangement in said link, said shock absorbing arrangement comprising a rubber spring and further including;

a spring case coupled to one of said pivots; and said rubber spring being coupled to the other of said pivots, wherein said rubber spring comprises a plurality of rubber bushings and a plurality of spacers interposed between said rubber bushings.

2. The exercise machine of claim 1, wherein the arrangement of said spring cage and said rubber spring establishes a variably sized pinch space; and the machine further comprises a pinch guard on an end of said rubber spring for preventing inadvertent access to said pinch space.

3. A glider exercise machine comprising:

a frame having rear pivots;

a pair of foot platforms having heel end pivots;

a pair of links coupled between said rear pivots and said heel end pivots for swingably supporting said pair of foot platforms from said frame; each of said links including:

a spring cage coupled to said rear pivot, said spring cage including an orifice through which said link freely passes; and a rubber spring arrangement coupled between said spring cage and said heel end pivot, wherein said rubber spring arrangement comprises a plurality of rubber bushings and a plurality of spacers interposed between said rubber bushings.

4. The exercise machine of claim 3, wherein the arrangement of said spring cage and said rubber spring establishes a variably sized pinch space; and the machine further comprises a pinch guard on an end of said rubber spring for preventing inadvertent access to said pinch space.

* * * * *